US012305414B2

(12) United States Patent
Fujii

(10) Patent No.: US 12,305,414 B2
(45) Date of Patent: May 20, 2025

(54) PORTABLE LIGHT BLOCKING DEN

(71) Applicant: Danielle Fujii, Sunnyvale, CA (US)

(72) Inventor: Danielle Fujii, Sunnyvale, CA (US)

(73) Assignee: Danielle Fujii, Sunnyvale, CA (US)

( * ) Notice: Subject to any disclaimer, the term of this patent is extended or adjusted under 35 U.S.C. 154(b) by 96 days.

(21) Appl. No.: 18/078,893

(22) Filed: Dec. 9, 2022

(65) Prior Publication Data

US 2023/0183998 A1 Jun. 15, 2023

Related U.S. Application Data

(60) Provisional application No. 63/265,241, filed on Dec. 10, 2021.

(51) Int. Cl.

| | |
|---|---|
| ***E04H 15/40*** | (2006.01) |
| ***A47C 29/00*** | (2006.01) |
| ***E04H 15/02*** | (2006.01) |
| ***E04H 15/32*** | (2006.01) |
| ***E04H 15/36*** | (2006.01) |
| ***E04H 15/44*** | (2006.01) |
| ***E04H 15/56*** | (2006.01) |
| ***E04H 15/58*** | (2006.01) |
| *A45B 23/00* | (2006.01) |

(52) U.S. Cl.

CPC ..... *E04H 15/405* (2013.01); *A47C 29/003* (2013.01); *E04H 15/02* (2013.01); *E04H 15/324* (2013.01); *E04H 15/36* (2013.01); *E04H 15/40* (2013.01); *E04H 15/44* (2013.01); *E04H 15/56* (2013.01); *E04H 15/58* (2013.01); *A45B 2023/0006* (2013.01)

(58) Field of Classification Search

CPC ..... E04H 15/02; E04H 15/324; E04H 15/36; E04H 15/40; E04H 15/44; E04H 15/56; E04H 15/405; E04H 15/58; A47C 29/003; A45B 2023/0006; A47D 13/06; A01K 1/033; A01K 1/034

USPC ..... 135/87, 96, 124–126, 122, 8, 136, 137, 135/116, 117, 128, 119; 5/121, 414, 5/417–420; 297/184.1, 184, 314, 184.15, 297/184.17; 119/474

See application file for complete search history.

(56) References Cited

U.S. PATENT DOCUMENTS 1,339,738 A * 5/1920 Callahan ..... A47C 31/105 5/484
1,546,613 A * 7/1925 Beman ..... E04H 15/32 135/117
1,732,878 A * 10/1929 Collender ..... B62B 9/142 296/110

(Continued)

*Primary Examiner* — Robert Canfield
(74) *Attorney, Agent, or Firm* — MORRISON & FOERSTER LLP

(57) ABSTRACT

A portable light blocking den comprising a light-weight opaque fabric, an arched rod frame with at least one front drape, wherein the light-weight opaque fabric encloses the arched rod frame, at least one mesh window in the light-weight opaque fabric with at least one interior flap, at least interior flap fastener to hold open or closed the at least one interior flap, at least front drape fastener to hold closed the at least one front drape, at least one loop tie-backs to hold open the at least one front drape, and a base wherein the base is quilted and padded and sewn to the arched rod frame. In some embodiments, the den may further comprise a back slit in the light-weight opaque fabric.

20 Claims, 8 Drawing Sheets

(56) References Cited

U.S. PATENT DOCUMENTS 2,055,044 A * 9/1936 Nelson ..... E04H 15/324 5/413 R
2,266,853 A * 12/1941 Dabney ..... E04H 15/003 D21/837
2,641,770 A * 6/1953 Chapin ..... A61G 5/10 135/117
2,666,441 A * 1/1954 Powers ..... E04H 15/32 135/117
3,675,667 A * 7/1972 Miller ..... E04H 15/40 135/905
3,960,161 A * 6/1976 Norman ..... E04H 15/40 135/93
4,077,417 A * 3/1978 Beavers ..... E04H 15/64 135/117
4,232,692 A * 11/1980 Atkins ..... A47C 29/006 5/418
4,590,956 A * 5/1986 Griesenbeck ..... E04H 15/56 5/113
4,651,370 A * 3/1987 Vitale ..... A47G 9/0246 5/500
4,652,040 A * 3/1987 Mahan ..... B60P 3/341 296/159
4,719,935 A * 1/1988 Gustafson ..... E04H 15/30 5/413 R
4,852,598 A * 8/1989 Griesenbeck ..... E04H 15/56 5/494
4,884,589 A * 12/1989 Simpson ..... E04H 15/001 135/900
5,078,096 A * 1/1992 Bishop ..... E04H 15/40 119/497
5,137,044 A * 8/1992 Brady ..... E04H 15/56 135/126
5,163,461 A 11/1992 Ivanovich et al.
D341,407 S * 11/1993 McLeese ..... D21/837
5,273,142 A * 12/1993 Weber ..... A45C 9/00 220/9.1
5,337,772 A * 8/1994 Habchi ..... E04H 15/40 135/156
5,439,018 A * 8/1995 Tsai ..... E04H 15/40 135/121
5,645,096 A 7/1997 Hazinski et al.
5,676,168 A * 10/1997 Price ..... E04H 15/40 135/125
5,718,254 A * 2/1998 Murphy ..... A47C 29/003 135/141
5,913,322 A * 6/1999 Gallant ..... E04H 15/42 D21/834
5,964,222 A * 10/1999 Kotliar ..... A61G 10/04 128/205.26
6,085,768 A * 7/2000 Arlotta ..... A45B 23/00 135/124
6,109,281 A 8/2000 Lowenthal
6,109,282 A * 8/2000 Yoon ..... E04H 15/40 135/124
6,311,709 B1 * 11/2001 Louie ..... E04H 15/40 446/478
6,672,323 B2 * 1/2004 Gupta ..... E04H 15/40 135/905
6,899,057 B1 * 5/2005 Chrisco ..... A01K 1/0254 119/498
7,225,822 B1 * 6/2007 Zheng ..... E04H 15/40 135/117
D574,918 S * 8/2008 McAlister ..... D21/834
7,698,756 B1 * 4/2010 Chen ..... A47C 17/72 135/96
D630,287 S 6/2011 Bell et al.
8,025,055 B1 * 9/2011 Grady ..... A61G 10/04 128/205.26
D646,741 S 10/2011 Akaka
8,453,664 B2 * 6/2013 Parsons ..... E04H 15/003 135/137
8,776,812 B1 * 7/2014 Forget ..... E04H 15/56 135/96
9,103,137 B2 * 8/2015 Williams ..... E04H 15/40
D749,686 S * 2/2016 Gilmore ..... D21/834
9,247,826 B1 * 2/2016 Holbrook ..... A47C 21/046
D778,383 S * 2/2017 Xu ..... D21/837
D802,226 S * 11/2017 Caputo ..... D30/108
D841,107 S * 2/2019 Zhu ..... D21/837
D872,208 S * 1/2020 Zhu ..... D21/834
D910,346 S * 2/2021 Ogilvie ..... D6/674
D916,223 S * 4/2021 Chen ..... D21/834
D921,148 S * 6/2021 Xiao ..... D21/837
11,293,195 B1 * 4/2022 Castle ..... H04R 1/025
D955,523 S * 6/2022 Li ..... D21/837
D960,277 S * 8/2022 Lah ..... D21/837
D961,035 S * 8/2022 Zhu ..... D21/834
D1,018,753 S * 3/2024 Fujii ..... D21/834
2003/0168093 A1 * 9/2003 Zheng ..... E04H 15/324 135/126
2004/0255996 A1 * 12/2004 Ross ..... E04H 15/40 135/126
2005/0045220 A1 * 3/2005 Sumner ..... E04H 15/32 135/117
2005/0188463 A1 * 9/2005 Onoufriou ..... A47G 9/0246 5/497
2006/0064818 A1 * 3/2006 Danaher ..... E04H 15/40 135/96
2007/0199155 A1 * 8/2007 Thygsen ..... A47C 31/105 5/699
2008/0105290 A1 * 5/2008 Ahn ..... E04H 15/42 135/124
2008/0163826 A1 * 7/2008 Kellogg ..... A01K 31/14 119/431
2008/0276978 A1 * 11/2008 Roux De La Beaume ..... E04H 15/38 135/92
2009/0007331 A1 * 1/2009 Lamstein ..... A01K 1/0353 5/418
2009/0301536 A1 * 12/2009 Cantwell ..... E04H 15/14 135/117
2010/0065094 A1 * 3/2010 Ways ..... E04H 15/34 135/96
2010/0154852 A1 * 6/2010 Trieu ..... A47G 9/086 493/405
2010/0269743 A1 * 10/2010 Marcangelo ..... D05B 11/00 5/498
2010/0293717 A1 * 11/2010 Carlitz ..... A47C 27/002 5/500
2011/0072591 A1 * 3/2011 Fang ..... A47C 31/105 5/737
2011/0088169 A1 * 4/2011 Soifer ..... A47C 31/00 5/694
2012/0152293 A1 * 6/2012 Lucero ..... E04H 15/14 135/117
2014/0190540 A1 * 7/2014 Herpin ..... E04H 15/40 135/115
2014/0224288 A1 * 8/2014 Mear ..... E04H 15/324 135/96
2016/0017631 A1 * 1/2016 Gilmore ..... E04H 15/324 135/143
2016/0115704 A1 * 4/2016 Burke ..... A61G 5/10 135/126
2016/0242567 A1 * 8/2016 Lime ..... A47C 29/003
2020/0018089 A1 * 1/2020 Moon ..... E04H 15/48
2020/0318376 A1 * 10/2020 Ruggiero ..... A61M 21/02
2020/0318378 A1 * 10/2020 Furuland ..... E04H 15/56
2022/0282517 A1 * 9/2022 Parks ..... E04H 15/58
2023/0119111 A1 * 4/2023 White ..... E04H 15/324 135/94
2023/0279693 A1 * 9/2023 Wickramasekera .. E04H 15/008 135/143
2024/0044167 A1 * 2/2024 Albawab ..... F04D 25/0673
2025/0012109 A1 * 1/2025 Aliberti ..... B63B 34/565

* cited by examiner

PORTABLE LIGHT BLOCKING DEN

CROSS REFERENCE TO RELATED APPLICATIONS

This application claims priority to U.S. Provisional Application No. 63/265,241, for "PORTABLE LIGHT BLOCKING DEN" filed on Dec. 10, 2021.

TECHNICAL FIELD

Aspects of the present disclosure relate to the field of sleep aids, and more specifically portable dens that reduce or block light.

BACKGROUND

According to a recent study conducted by Northwestern University, even moderate ambient lighting during sleep can adversely affect a person's health and well-being. Lack of sleep can reduce focus, hinder memory and concentration, decrease mental activity, harm heart health, lower energy levels, weaken the immune system, diminish overall health and more. Light can also be a hindrance to sleep if a person needs to sleep during the day.

Previous light reducing items include sleep masks and blackout curtains. However, these aids may be uncomfortable to wear, not recommended for long-term use, not reduce sufficient stimulant, or have other adverse side effects. There is a need, therefore, for a better light reducing sleep aid.

SUMMARY

In view of the aforesaid disadvantages now present in the prior art, the present invention provides a new kind of sleeping aid that can create better "black out" conditions and improve sleep, without the use of drugs, is non-invasive and non-electronic.

The object of the present invention is achieved through the following technical solution: a tent comprising a flexible frame that blocks light to create a dark sleep space any time of day. The tent, or den, may be sufficiently large enough to cover the head and a portion of the upper torso of a user. This allows the rest of the body to remain outside of the den, and avoid entrapment and other safety or comfort issues that come with larger, full body tents.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

Figure 1:
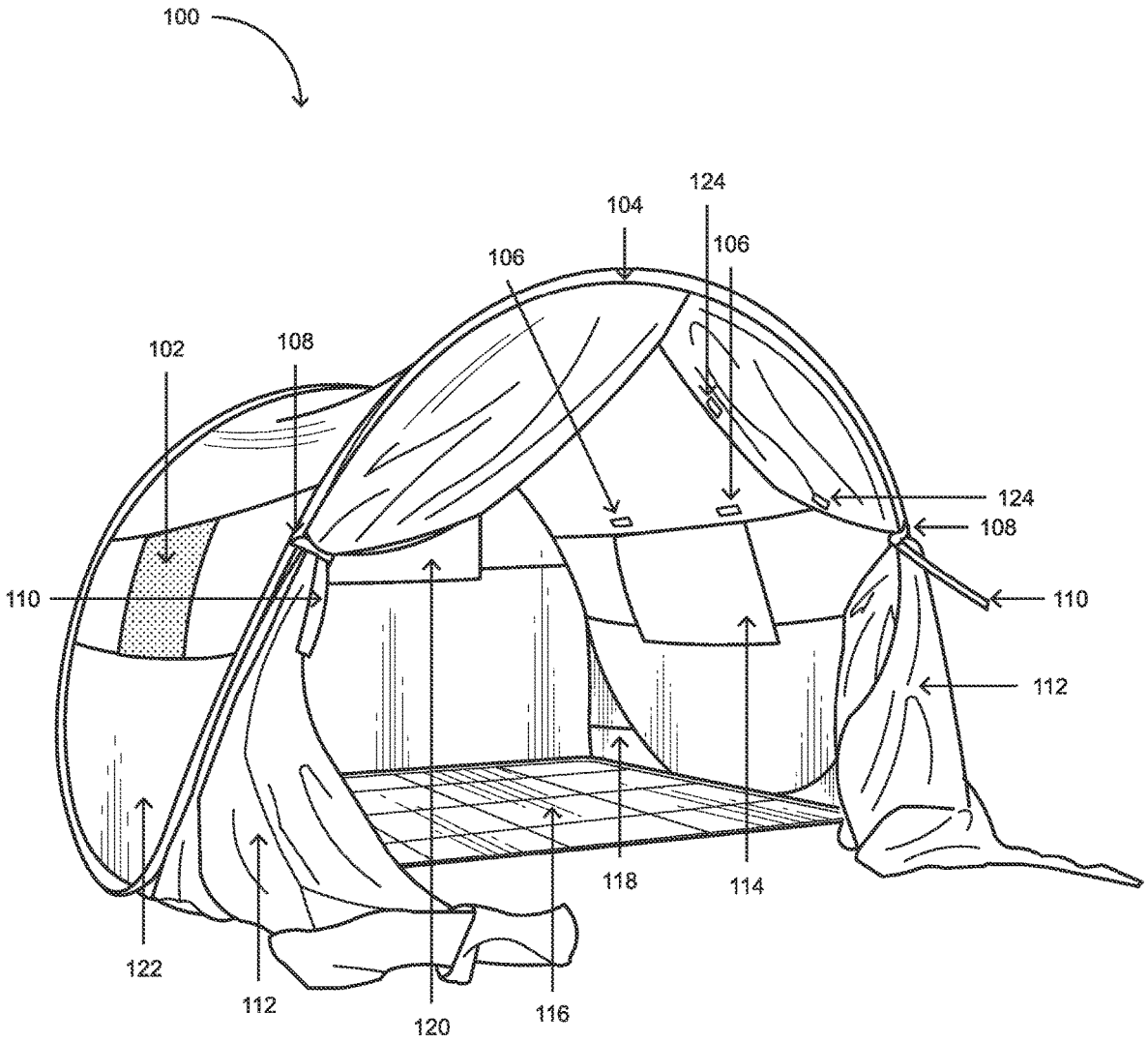
FIG. 1 is a diagram that illustrates some embodiments of the present disclosure.

The portable light blocking den may be constructed of opaque fabric covering a flexible, arched fiberglass rod frame with angled front drapes, at least two mesh windows with interior flaps, one on a side, one on the back of the dome-shaped covering, a quilted, padded base, and a back slit. The portable light blocking den drapes may be tied open using loop-tie holds or closed using hook and loop fasteners. The portable light blocking den window flaps may be rolled up and held open using hook and loop fasteners for increased air circulation or closed using hook and loop fasteners to block out light. The back slit may be a side-back pass-through slits designed to facilitate a CPAP (continuous positive airway pressure) tube and cord being pulled through and connected to a device, if desired.

The portable light blocking den may be used on a bed or any other stable flat surface to create a darkened, personal, and private space for rest, sleep, or to avoid/block out light. The portable light blocking den can be removed from a carrying case, flipped open (no tools required), placed on a stable flat surface, and used by placing head, shoulders, and chest into the den.

The portable light blocking den may comprise two front drapes which may be fully opened, partially closed (one tied back and one down) or completely closed, to control the amount of light, temperature level, and airflow inside the den. The portable light blocking den may comprise one or more window flaps which may be closed for increased darkness and temperature level or opened for increased light and airflow within the den. The portable light blocking den provides benefits of being compact and providing the ability to fit into a suitcase when folded according to instructions and secured in the carrying case. The portable light blocking den may be used in various ways to help users by creating a darkened environment for the following purposes or under the following conditions, including but not limited to: sleeping or relaxing during the day or night; meditating; suppressing conditions where light sensitivity is prevalent (such as fibromyalgia, ADD or ADHD, migraines or cluster headaches, post-concussion syndrome, traumatic brain injury, or photosensitive epilepsy); sleeping during daylight hours to work a night, swing shift, split shift or graveyard shift; power napping; cohabitating with someone who sleeps with a light on, reads, or works in bed; living in shared rooms—such as a dorm (students—sleeping and studying at different times) or fire station (firefighter dorm rooms) or hospital lounge (nurses, doctors, interns who must rest on-site); admitted hospital patients who need sleep to recover and privacy but are unable to sleep with hospital staff coming in and out all hours of day and night; residing in temporary housing such as evacuation centers (Red Cross Shelters, emergency evacuation housing or disaster relief shelters); military personnel with varying awake/sleep schedules; pilots and flight staff who need to sleep between flights in varying time zones; travelling or staying in a hotel; creating a private space when needing to block light and rest or sleep anywhere away from home.

The portable light blocking den may block different sources of light, including but not limited to: light bleeds (edges of curtains, blinds, shades), night lights, computers, charging devices, clocks, phones, book lights, bedside lights, overhead room lights, street lights, safety alarm indicator lights, surge protectors, home alarm panels, skylights, windows, doors, docking stations, televisions, tablets, cell phones, cable boxes, fans, light switches and other sources of light, either natural or man-made.

FIG. 1 illustrates a tent in accordance with some embodiments of the present disclosure. Den 100 comprises Side Mesh Window 102, Rod 104, Fasteners 106, Loops 108, Ties 110, Drapes 112, Side Mesh Window Cover 114, Bottom Pad 116, Slit 118, Rear Mesh Window Cover 120, and Den Body Fabric 122, and Front Drape Fasteners 124. Side Mesh Window 102 is made of a fabric mesh, and can allow air to flow in or out of Den 100. Rod 104 may be a flexible fiberglass rod that is encased in a fabric channel and is the main support for Den 100. Fasteners 106 can be used to hold open a cloth or other cover flap for Side Mesh Window 102, and may be made of Velcro or similar materials in some embodiments. Loops 108 can be used to pull Ties 110 through to hold open Drapes 112. Drapes 112 may be isometric drapes, may overlap with each other, and may be made of a light blocking fabric, such as a very dense lightweight polyester blend fabric. Side Mesh Window Cover 114 may also be made of the same material as Drapes 112, Den Body Fabric 122, or similar light blocking fabric, and can be used to cover, or close, Side Mesh Window 102. Bottom Pad 116, in some embodiments, may be made of the same material as Den Body Fabric 122 with cotton or polyester batting for padding and sewn securely to Rod 104. Slit 118 is a slit in Den Body Fabric 122 and may be used as a way for CPAP tubing or cords to enter Den 100 with minimal light. There may be one Slit 118, or multiple Slits 118, for example, on the left end and right end of Den 100. Slit 118 may also be in the center rear of Den 100. Den Body Fabric 122 may be comprised of a very dense lightweight polyester blend fabric, and is over Rod 104. Rod 104 may be in a stronger fabric called Polyester Oxford in some embodiments. Front Drape Fasteners 124 can be used to hold Drapes 112 closed.

In some embodiments, Rod 104 may be between the lengths of 120 inches and 250 inches.

Figure 2:
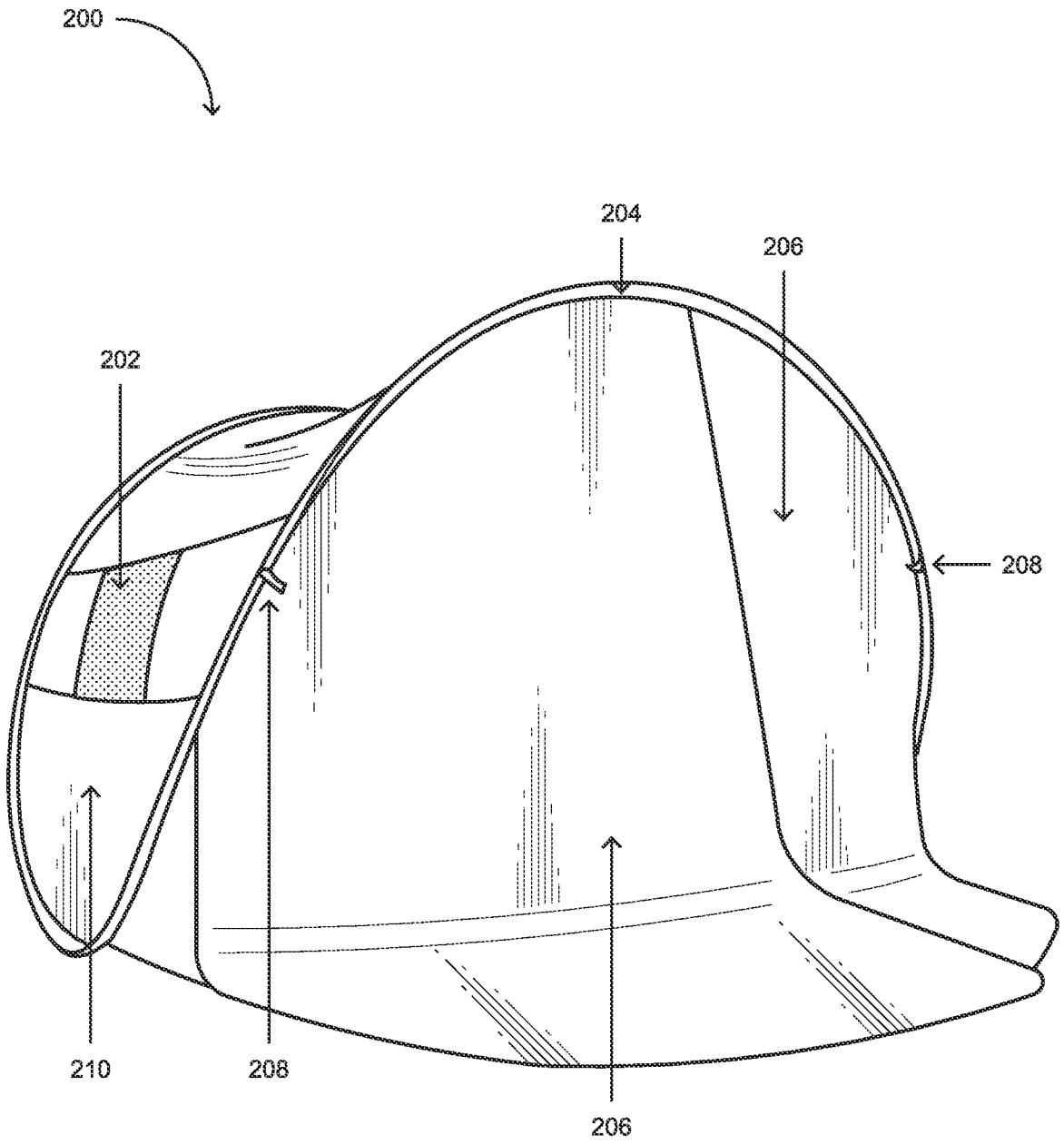
FIG. 2 is a diagram that illustrates some embodiments of the present disclosure.

FIG. 2 illustrates a tent in accordance with some embodiments of the present disclosure. Den 200 is the same tent as Den 100 in FIG. 1, but with drapes closed. Den 200 comprises Side Mesh Window 202, Rod 204, Drapes 206, Loops 208, and Den Body Fabric 210. Side Mesh Window 202 is made of a fabric mesh, and can allow air to flow in or out of Den 200. Rod 204 may be a flexible fiberglass rod that is encased in a fabric channel and is the main support for Den 200. Drapes 206 may be isometric drapes, may overlap with each other, and may be made of a light blocking fabric, such as a very dense lightweight polyester blend fabric. Loops 208 can be used to hold open Drapes 206. Den Body Fabric 210 may be comprised of a very dense lightweight polyester blend fabric, and is over Rod 204. Rod 204 may be in a stronger fabric called Polyester Oxford in some embodiments.

Figure 3:
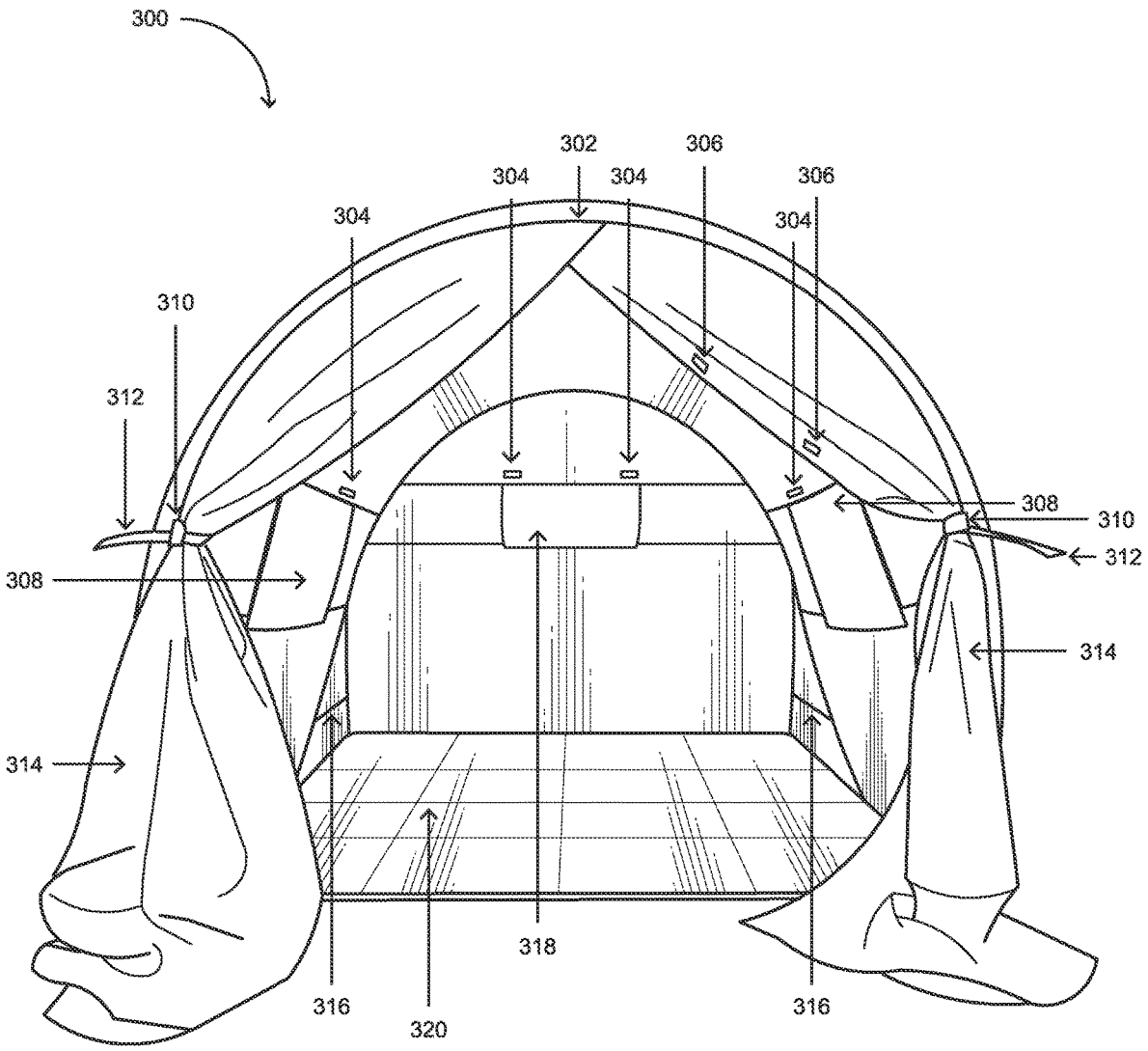
FIG. 3 is a diagram that illustrates a front view of some embodiments of the present disclosure.

FIG. 3 illustrates a tent in accordance with some embodiments of the present disclosure. Den 300 is the same tent as Den 100 in FIG. 1, but with a front view and with isometric drapes open. Den 300 comprises Rod 302, Fasteners 304, Front Drape Fasteners 306, Side Mesh Window Mesh Covers 308, Loops 310, Ties 312, Drapes 314, Slits 316, Rear Mesh Window Cover 318, and Bottom Pad 320. Rod 302 may be a flexible fiberglass rod that is encased in a fabric channel and is the main support for Den 300, Fasteners 304 can be used to hold open a cloth or other cover flap, i.e. Side Mesh Window Cover 308. Front Drape Fasteners 306 can be used to hold Drapes 314 closed, and may be comprised of Velcro, in some embodiments. Side Mesh Window Mesh Cover 308 may be made of light blocking fabric, such as a very dense lightweight polyester blend fabric. Loops 310 can be used to pull Ties 312 through to hold open Drapes 314. Drapes 314 may be isometric drapes, may overlap with each other, and may be made of a light blocking fabric, such as a very dense lightweight polyester blend fabric. Slit 316 is a slit in a fabric over Rod 302, and may be used as a way for CPAP tubing or cords to enter Den 300 with minimal light. There may be one Slit 316, or multiple Slits 316, for example, on the left end and right end of Den 300. Slit 316 may also be in the center rear of Den 300. Rear Mesh Window Cover 318 may be made of light blocking fabric, such as a very dense lightweight polyester blend fabric, i.e. the same as Side Mesh Window Cover 308, and be used to cover a rear mesh window (not shown). Bottom Pad 320 may be made of the same material as the fabric over Rod 302, with cotton or polyester batting for padding and sewn securely to Rod 302.

Figure 4:
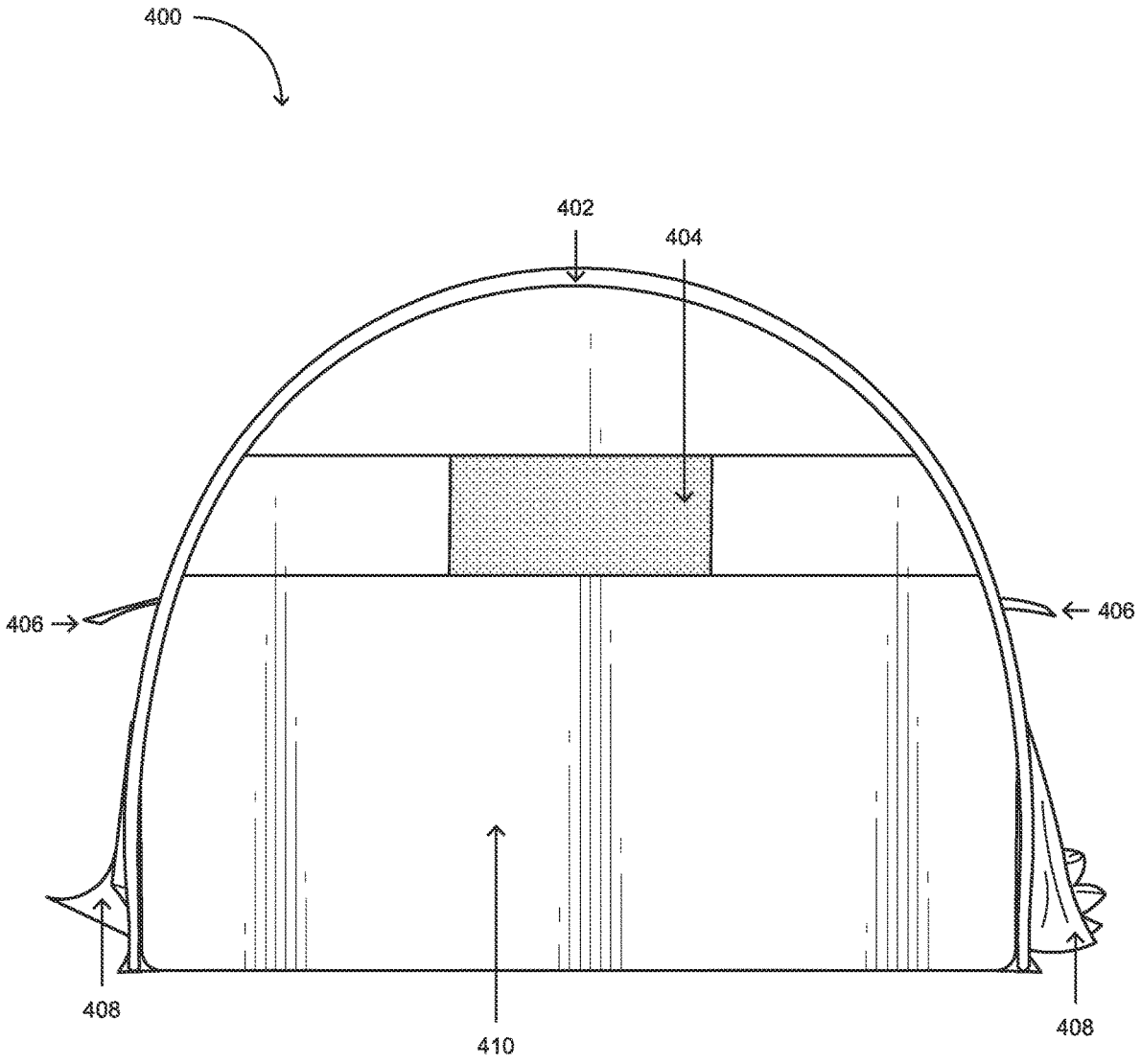
FIG. 4 is a diagram that illustrates a back view of some embodiments of the present disclosure.

FIG. 4 illustrates a tent in accordance with some embodiments of the present disclosure. Den 400 is the same tent as Den 100 in FIG. 1, but showing a back view. Den 400 comprises Rod 402, Rear Mesh Window 404, Ties 406, Drapes 408 (shown open), and Den Body Fabric 410. Rod 402 may be a flexible fiberglass rod that is encased in a fabric channel and is the main support for Den 400. Rear Mesh Window 404 is made of a fabric mesh, and can allow air to flow in or out of Den 400. Optionally, there may be a rear mesh window cover (not shown) to cover Rear Mesh Window 404 from the inside. Ties 406 may be a drape tie pushed through a loop (not shown) to hold open Drapes 408. Drapes 408 may be isometric drapes, may overlap with each other, and may be made of a light blocking fabric, such as a very dense lightweight polyester blend fabric. Den Body Fabric 410 may be comprised of a very dense lightweight polyester blend fabric, and is over Rod 402.

Figure 5:
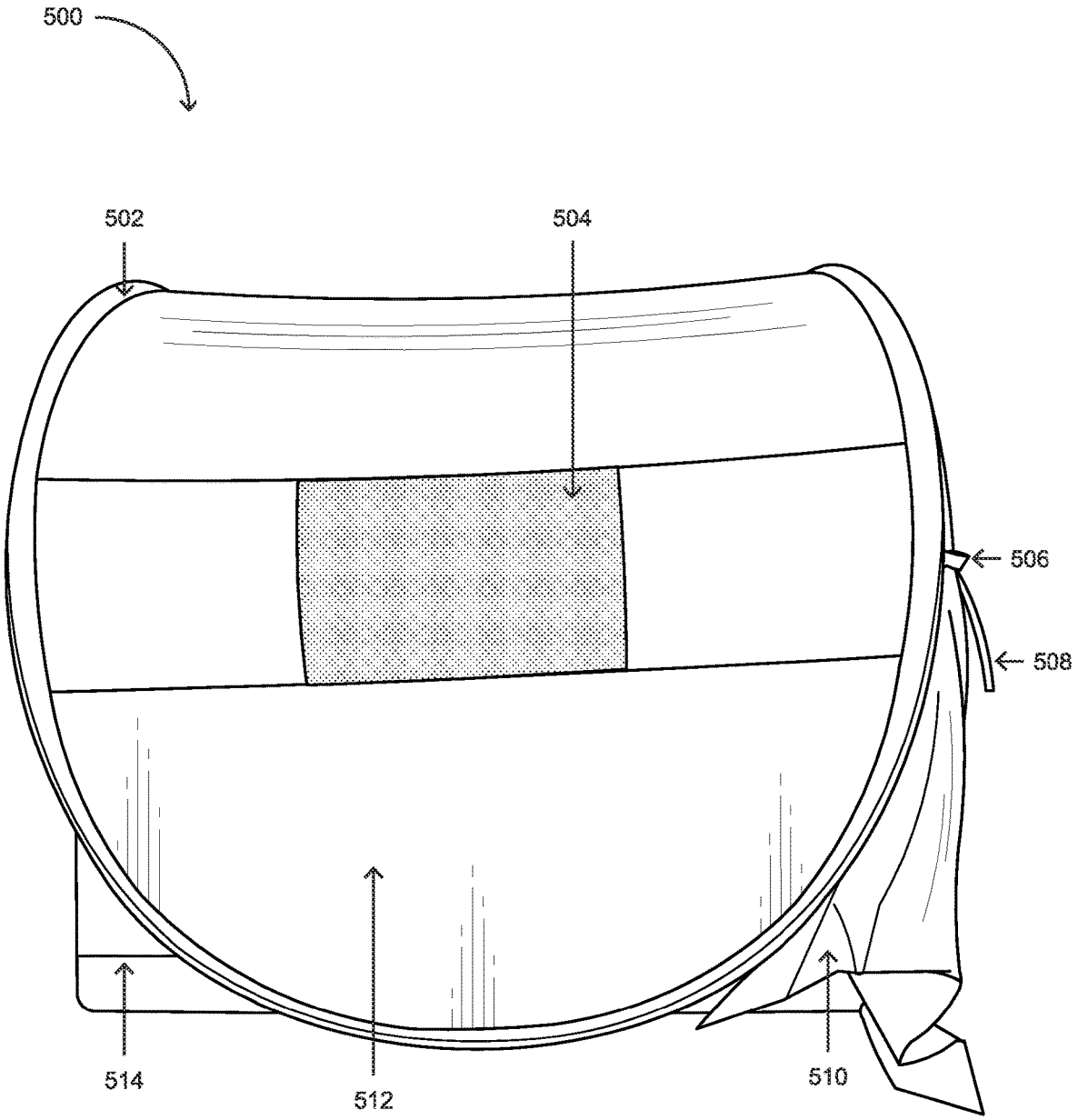
FIG. 5 is a diagram that illustrates a side view of some embodiments of the present disclosure.

FIG. 5 illustrates a tent in accordance with some embodiments of the present disclosure. Den 500 is the same tent as Den 100 in FIG. 1, but showing a side view. Den 500 comprises Rod 502, Side Mesh Window 504, Loop 506, Tie 508, Drape 510, Den Body Fabric 512, and Slit 514. Rod 502 may be a flexible fiberglass rod that is encased in a fabric channel and is the main support for Den 500. Side Mesh Window 504 is made of a fabric mesh, and can allow air to flow in or out of Den 500. Optionally, there may be a side mesh window cover (not shown) to cover Side Mesh Window 504 from the outside. Loop 506 can be used to pull Tie 508 through to hold open Drapes 510, and may be made of a plastic material, or made of same fabric as den, in some embodiments. Tie 508 may be a drape tie pushed through Loop 506 to hold open Drape 510. Drape 510 may be isometric drapes, may overlap with each other, and may be made of a light blocking fabric, such as a very dense lightweight polyester blend fabric. Den Body Fabric 512 may be comprised of a very dense lightweight polyester blend fabric, and is over Rod 502. Slit 514 is a slit in Den Body Fabric 512 and may be used as a way for CPAP tubing or cords to enter Den 500 with minimal light.

Figure 6:
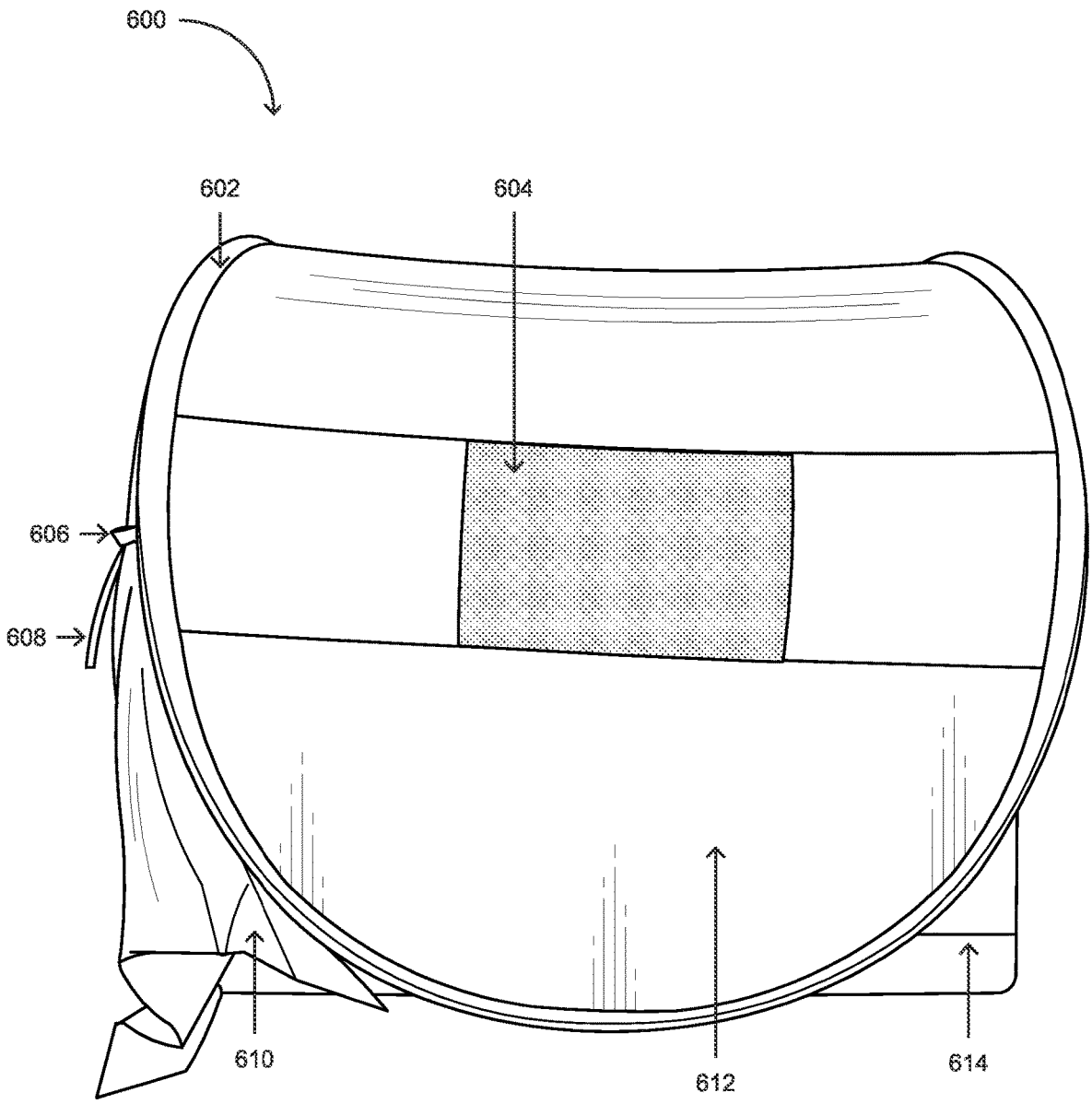
FIG. 6 is a diagram that illustrates a side view of some embodiments of the present disclosure.

FIG. 6 illustrates a tent in accordance with some embodiments of the present disclosure. Den 600 is the same tent as Den 600 in FIG. 1, but showing a side view. Den 600 comprises Rod 602, Side Mesh Window 604, Loop 606, Tie 608, Drape 610, Den Body Fabric 612, and Slit 614. Rod 602 may be a flexible fiberglass rod that is encased in a fabric channel and is the main support for Den 600. Side Mesh Window 604 is made of a fabric mesh, and can allow air to flow in or out of Den 600. Optionally, there may be a side mesh window cover (not shown) to cover Side Mesh Window 604 from the inside. Loop 606 can be used to pull Tie 608 through to hold open Drapes 610, and may be made of a plastic, made of same fabric as den, material in some embodiments. Tie 608 may be a drape tie pushed through Loop 606 to hold open Drape 610. Drape 610 may be isometric drapes, may overlap with each other, and may be made of a light blocking fabric, such as a very dense lightweight polyester blend fabric. Den Body Fabric 612 may be comprised of a very dense lightweight polyester blend fabric, and is over Rod 602. Slit 614 is a slit in Den Body Fabric 612 and may be used as a way for CPAP tubing or cords to enter Den 600 with minimal light.

Figure 7:
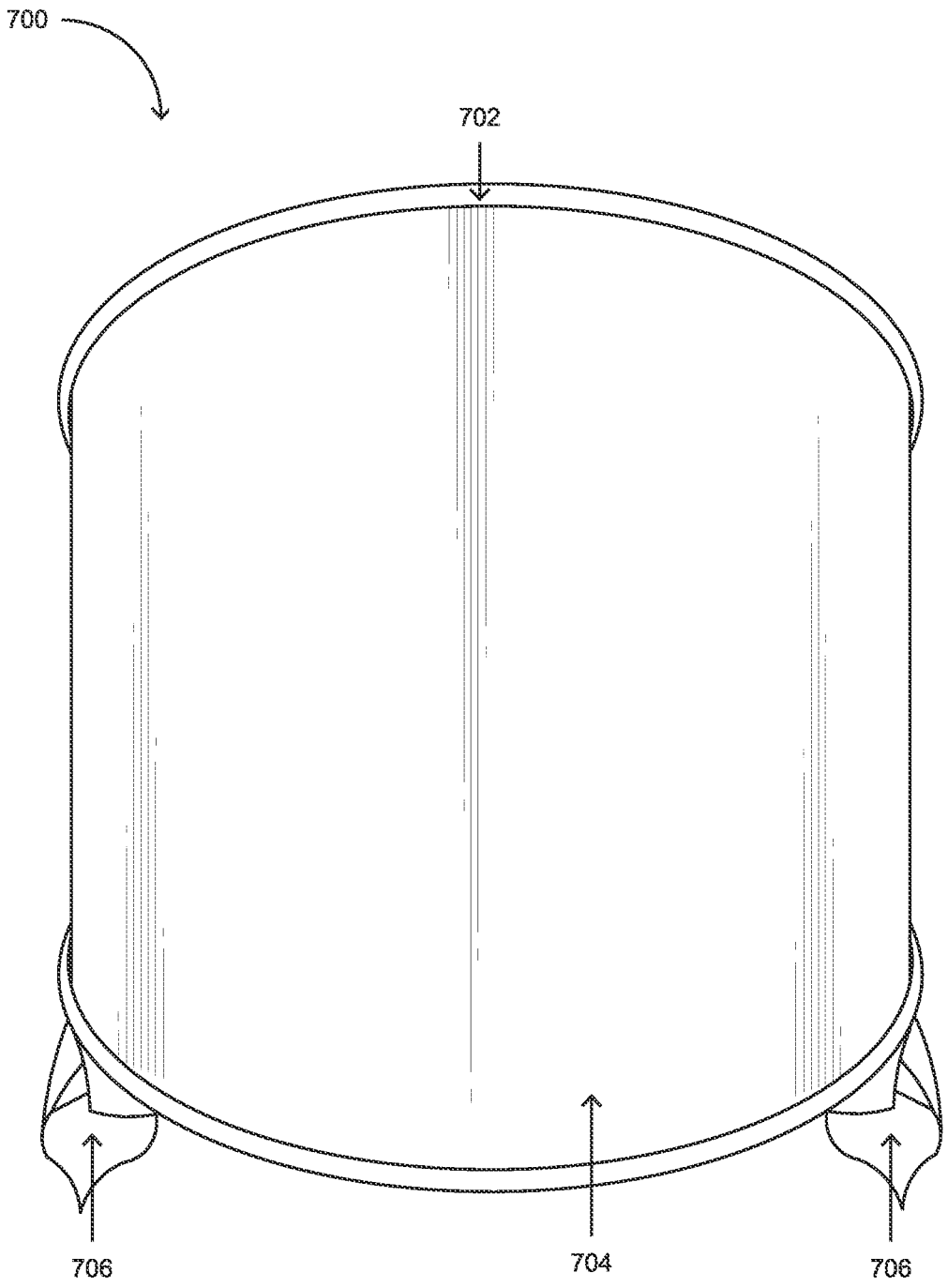
FIG. 7 is a diagram that illustrates a top view of some embodiments of the present disclosure.

FIG. 7 illustrates a tent in accordance with some embodiments of the present disclosure. Den 700 is the same tent as Den 100 in FIG. 1, but showing a top view. Den 700 comprises Rod 702, Den Body Fabric 704, and Drapes 706. Rod 702 may be a flexible fiberglass rod that is encased in a fabric channel and is the main support for Den 700. Den Body Fabric 704 may be comprised of a very dense lightweight polyester blend fabric, and is over Rod 702. Drapes 706 may be isometric drapes, may overlap with each other, and may be made of a light blocking fabric, such as a very dense lightweight polyester blend fabric.

Figure 8:
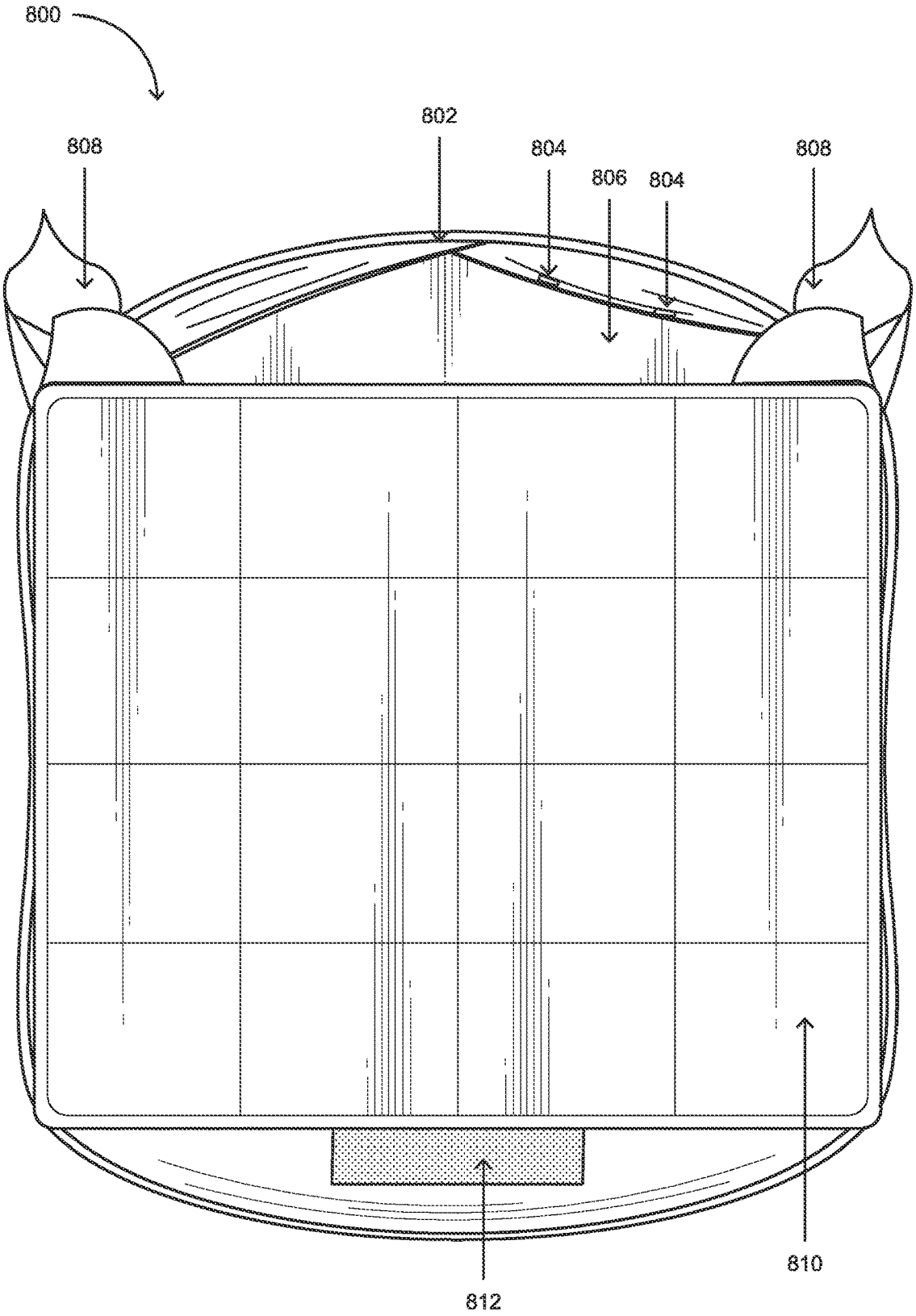
FIG. 8 is a diagram that illustrates a bottom view of some embodiments of the present disclosure.

FIG. 8 illustrates a tent in accordance with some embodiments of the present disclosure. Den 800 is the same tent as Den 100 in FIG. 1, but showing a bottom view. Den 800 comprises Rod 802, Fasteners 804, Den Body Fabric 806, Drapes 808, Bottom Pad 810, and Rear Mesh Window 812. Rod 802 may be a flexible fiberglass rod that is encased in a fabric channel and is the main support for Den 800. Fasteners 804 can be used to hold Drapes 808 open or closed, and may be made of Velcro or similar materials in some embodiments. Den Body Fabric 806 may be comprised of a very dense lightweight polyester blend fabric, and is over Rod 802. Drapes 808 may be isometric drapes, may overlap with each other, and may be made of a light blocking fabric, such as a very dense lightweight polyester blend fabric. Bottom Pad 810, in some embodiment may be made of the same material as Den Body Fabric 806, with cotton or polyester batting for padding and sewn securely to Rod 802. Rear Mesh Window 812 is made of a fabric mesh and can allow air to flow in or out of Den 800.

The terms "first," "second," "third," "fourth," etc., as used herein are meant as labels to distinguish among different elements and may not necessarily have an ordinal meaning according to their numerical designation.

The above description is intended to be illustrative, and not restrictive. Although the present disclosure has been described with references to specific illustrative examples, it will be recognized that the present disclosure is not limited to the examples described. The scope of the disclosure should be determined with reference to the following claims, along with the full scope of equivalents to which the claims are entitled.

As used herein, the singular forms "a", "an" and "the" are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof. Therefore, the terminology used herein is for the purpose of describing particular embodiments only and is not intended to be limiting.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Although the method operations were described in a specific order, it should be understood that other operations may be performed in between described operations, described operations may be adjusted so that they occur at slightly different times or the described operations may be distributed in a system which allows the occurrence of the processing operations at various intervals associated with the processing.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the embodiments and its practical applications, to thereby enable others skilled in the art to best utilize the embodiments and various modifications as may be suited to the particular use contemplated. Accordingly, the present embodiments are to be considered as illustrative and not restrictive, and the invention is not to be limited to the details given herein, but may be modified within the scope and equivalents of the appended claims.

What is claimed is:

1. A portable and foldable light-blocking den configured to sit on a stable flat surface, wherein the den has a front, a back, a bottom and continuous top and sides, and wherein the den comprises:

an arched rod frame that comprises a single flexible rod shaped to form (i) a front arch framing the front of the den and (ii) a back arch framing the back of the den, wherein (iii) the front arch and the back arch are connected through the rod that forms a U-shape curve framing each side of the den;

wherein the single flexible rod is enclosed in a fabric channel, and the fabric channel connects body fabric, front drapes, and a padded base;

wherein the body fabric is attached to the fabric channel of the arched rod frame and to the padded base to form the back and the continuous top and sides, thereby creating an interior space;

wherein the front drapes comprise two pieces of fabric that are sewn to the fabric channel of the front arch;

wherein the two pieces of fabric are overlapping where sewn to the top of the front arch;

wherein the front drapes, when held closed and are overlapping, form a front wall that encloses the interior space; and wherein the front drapes, when held opened, form an opening in the front of the den that allows a user to enter into the interior space;

wherein the interior space is sized and configured to cover a head and a portion of the upper torso of the user positioned inside the den allowing the rest of the body of the user to remain outside of the den; and wherein the padded base comprises batting, and is sewn to body fabric on the back and sides of the den to form the bottom of the den that is configured to sit on top of the stable flat surface.

2. The den of claim 1, wherein the rod has a length between 120 inches and 250 inches.

3. The den of claim 1, wherein the rod is a flexible fiberglass rod.

4. The den of claim 1, wherein the front drapes and the body fabric independently comprise light-weight opaque fabric.

5. The den of claim 1, wherein the front drapes and the body fabric independently comprise light blocking fabric.

6. The den of claim 1, wherein the front drapes and body fabric are made of the same material.

7. The den of claim 1, wherein the front drapes are configured to be held open by ties attached to the front drapes that are pulled through loops attached to the sides of the front arch.

8. The den of claim 1, wherein the front drapes are configured to be held closed and overlapping by front drape fasteners, thereby forming a front wall that completely encloses the interior space.

9. The den of claim 1, wherein the padded base has a nearly-square rectangular shape.

10. The den of claim 1, wherein the padded base is quilted.

11. The den of claim 1, wherein the batting of the padded base comprises cotton or polyester batting.

12. The den of claim 1, further comprising at least one mesh window connected to the body fabric, wherein each mesh window is attached to a mesh window cover.

13. The den of claim 12, wherein a mesh window is positioned on one or both sides of the den, or a mesh window is positioned at the back of the den, or a combination thereof.

14. The den of claim 12, wherein the mesh window comprises fabric mesh that is configured to allow air to flow in or out of the den.

15. The den of claim 12, wherein the mesh window cover comprises light-weight fabric.

16. The den of claim 12, wherein the mesh window cover comprises light-weight blackout fabric.

17. The den of claim 12, wherein the mesh window cover comprises light blocking fabric.

18. The den of claim 12, wherein the front drapes, body fabric and the mesh window cover are made of the same material.

19. The den of claim 1, further comprising at least one back slit configured to allow a continuous positive airway pressure tube or cord to enter the den with minimal light.

20. A den having a front, a bottom, and continuous top and sides, wherein the den comprises:

an arched rod frame that comprises a single flexible rod shaped to form (i) a front arch framing the front of the den and (ii) a back arch framing the back of the den, wherein (iii) the front arch and the back arch are connected through the rod that forms a U-shape curve framing each side of the den;

wherein the single flexible rod is enclosed in a fabric channel, and the fabric channel connects body fabric, front drapes, and a padded base;

wherein the rod has a length between 120 inches and 250 inches;

wherein the body fabric is attached to the fabric channel of the arched rod frame and to the padded base to form the back and the continuous top and sides, thereby creating an interior space;

wherein the interior space is sized and configured to cover a head and a portion of the upper torso of the user positioned inside the den allowing the rest of the body of the user to remain outside of the den;

wherein the front drapes comprise two pieces of fabric that are sewn to the fabric channel of the front arch;

wherein the two pieces of fabric are overlapping where sewn to the top of the front arch;

wherein the front drapes are configured to be held closed and overlapping by front drape fasteners, thereby forming a front wall that completely encloses the interior space;

wherein the front drapes are configured to be held open by ties attached to the front drapes pulled through loops attached to the sides of the front arch, thereby form an opening in the front of the den that allows a user to enter into the interior space; and wherein the padded base comprises batting, and is sewn to body fabric on the back and sides of the den to form the bottom of the den that is configured to sit on top of the stable flat surface.

* * * * *